United States Patent [19]

Bourgeois, Jr.

[11] Patent Number: 4,655,297

[45] Date of Patent: Apr. 7, 1987

[54] CONVERTIBLE SPREADER GRADER ASSEMBLY

[75] Inventor: Leverence Bourgeois, Jr., Raceland, La.

[73] Assignee: Robert P. Chatelain, New Orleans, La.

[21] Appl. No.: 691,629

[22] Filed: Jan. 15, 1985

Related U.S. Application Data

[63] Continuation-in-part of Ser. No. 571,703, Jan. 18, 1984, Pat. No. 4,572,301, and a continuation-in-part of Ser. No. 571,385, Jan. 18, 1984, abandoned.

[51] Int. Cl.[4] ..... E02F 3/76; E02F 3/815

[52] U.S. Cl. ..... 172/445.1; 37/117.5

[58] Field of Search ..... 172/799.5, 780, 781, 172/701.1, 445.1, 445.2, 815, 26.5, 26.6, 787, 684.5; 37/124, 125, 122, 128, 133, 136, 117.5

[56] References Cited

U.S. PATENT DOCUMENTS

| | | | |
|---|---|---|---|
| 291,396 | 1/1884 | Pennock | 172/739 |
| 897,124 | 8/1908 | Mitchell | 172/684.5 |
| 1,080,252 | 12/1913 | Bolt | 172/684.5 |
| 1,133,877 | 3/1915 | Monroe | 172/684.5 |
| 1,368,585 | 2/1921 | Vigil | 172/393 |
| 1,509,189 | 9/1924 | Carlson | 172/684.5 |
| 1,522,331 | 1/1925 | Schaeffer | 172/684.5 |
| 1,755,631 | 4/1930 | Burnett | 172/684.5 |
| 1,831,329 | 11/1931 | Thier | 172/698 |
| 2,552,426 | 5/1951 | Hedley | 37/149 |
| 2,620,716 | 12/1952 | Ciancio | 172/445.1 |
| 2,624,133 | 1/1953 | Smeed | 172/780 |
| 2,814,891 | 12/1957 | Puckett | 37/148 |
| 2,815,591 | 12/1957 | Mattingly | 172/445.1 |
| 2,849,735 | 9/1958 | Thompson | 172/26.5 X |
| 3,121,964 | 2/1964 | Cobb | 172/701.1 |
| 3,474,550 | 10/1969 | Frank | 172/799.5 |
| 4,320,988 | 3/1982 | Seal | 172/445.1 |

FOREIGN PATENT DOCUMENTS

| | | | |
|---|---|---|---|
| 2009059 | 9/1970 | Fed. Rep. of Germany | 172/776 |
| 1632771 | 12/1970 | Fed. Rep. of Germany . | |
| 1416516 | 9/1965 | France | 172/776 |
| 184024 | 11/1966 | U.S.S.R. | 172/445.1 |

*Primary Examiner*—Richard J. Johnson

*Attorney, Agent, or Firm*—Lalos, Keegan & Kaye

[57] ABSTRACT

A convertible spreader-grader assembly convertible between a spreader-grader mode and a box scraper mode. The assembly includes a pair of spaced skid sleds, an interior framework positioned between and connected to them to maintain them in parallel longitudinal relation, and a hitch assembly connected to the framework for attaching the assembly to a suitable tractor. At least one cutter assembly extends between the skid sleds and is connected thereto by an adjustable mounting mechanism which provides for a plurality of positions of the cutting plate relative to the ground. For each position the blade assumes the same angle to the ground but has a different height of its lower edge relative to the ground. A plate extends between the skid sleds at a rear portion thereof. It is pivotally connected to them and can pivot between an upper horizontal position wherein earth and soil can pass underneath wherein the assembly defines its spreader grader mode. The plate can be pivoted to a second more nearly vertical position resting on the cutter assembly and forming therewith a back wall such that the assembly defines a box scraper. Extension members can be bolted to either side of the framework and the skid sleds to extend the distance between the sleds and thus the width of the assembly. Similar extension assemblies are provided for either side of the cutter assemblies and are readily bolted to them.

29 Claims, 8 Drawing Figures

CONVERTIBLE SPREADER GRADER ASSEMBLY

BACKGROUND OF THE INVENTION

The present application is a continuation-in-part of applicant's co-pending applications, Ser. No. 571,385, filed Jan. 18, 1984, now abandoned and Ser. No. 571,703, filed Jan. 18, 1984, now U.S. Pat. No. 4,572,301 the contents of both of which are hereby incorporated by reference in their entirety.

The present invention relates to spreader-graders of the type towed by tractors or similar farm machinery and more particularly to those type of recently developed spreader-graders having internally adjustable blades. The present invention also relates to box scraper assemblies.

Numerous spreader-graders are known in the prior art and they generally comprise a pair of parallel skid sleds, a framework between them keeping them in parallel alignment and one or more cutting blade assemblies attached to the skid rails and adapted to engage the ground. These assemblies are used to cut high spots in the ground, fill low spots and to spread loose material to a level condition for roads, parking lots and fields for irrigation. They can prepare a solid base or foundation for finished highways or paved roads. They are further used to spread top soil to prepare it for seeding. There also have been spreader-graders with means for adjusting the blade positions relative to the ground as, for example, the assembly of U.S. Pat. No. 4,320,988. However, the mechanism for readjusting the position has caused stresses to concentrate on the blades and to result in early failure through fractures or breakage as well as seizing and jamming of the pivot joints rendering the unit inoperable. It further has proven to be a complicated and costly design requiring frequent repair, and limited blade repositioning movement. Numerous box scrapers are also known in the art, and they are used for many purposes including landscaping, grading, leveling, road building, snow removal, and numerous other material handling purposes.

In the past a user would typically be faced with a variety of tasks relative to spreading, grading and hauling. To efficiently and effectively do these jobs especially for big projects, it was necessary to have a variety of different pieces of equipment on hand. Each piece of equipment would be used on a different task as, for example, for grading around a dwelling, grading in the field, grading alongside a highway, hauling different materials, and grading different types of materials to different depths. Also it was frequently necessary to haul different volumes and varieties of materials for which small box scrapers would be too small to adequately handle the job and for which a larger scraper might either not be available or might be too large to efficiently handle the job. It further was often found necessary to switch back and forth between pulling a spreader-grader and pulling a box scraper wasting very valuable time in the switch. Thus, a strong need has existed for an assembly which could be easily adapted for each of these different uses, and which further could be easily adapted in the field to these uses with a limited number of tools. Further, it is desirable to have an assembly which can be easily transported on the highways.

OBJECTS OF THE INVENTION

Accordingly, it is the principal object of the present invention to provide an improved spreader-grader assembly.

Another object of the present invention is to provide an improved box scraper apparatus.

A further object of the present invention is to provide an improved spreader-grader apparatus and an improved box scraper with an adjustable blade support that does not seize or jam.

A still further object of the present invention is to provide an improved spreader-grader and box scraper with an adjustable blade support that reduces the forces and stresses imposed on the blades.

Another object is to provide an improved spreader-grader and box scraper that can be easily adapted to have different blade and assembly widths to accommodate different uses, and adaptable for easy transport on the roads.

A further object is to provide novel spreader-grader and box scraper that can be easily dismantled for shipping.

A still further object is to provide a novel spreader-grader and box scraper that can be easily assembled.

Another object of the present invention is to provide a novel spreader-grader and box scraper that can handle any size job and is virtually maintenance free.

A further object is to provide novel spreader-grader and box scraper designs which reduce the number of different pieces of equipment needed for handling a wide variety of spreading, grading and hauling jobs.

A still further object is to provide a novel spreader-grader and box scraper that is easily adjustable in the field with limited tools.

Another object is to provide an improved spreader-grader and box scraper constructions which have increased reliability, ease of use in the field, and economy of construction.

A further object is to provide a novel spreader-grader and box scraper for which the front and back blade assemblies can be easily interchanged and the assemblies easily replaced.

Other objects and advantages of the present invention will become more apparent to those persons having ordinary skill in the art from the following description taken in conjunction with the accompanying drawings.

DETAILED DESCRIPTION OF THE PREFERRED EMBODIMENTS

Figure 1:
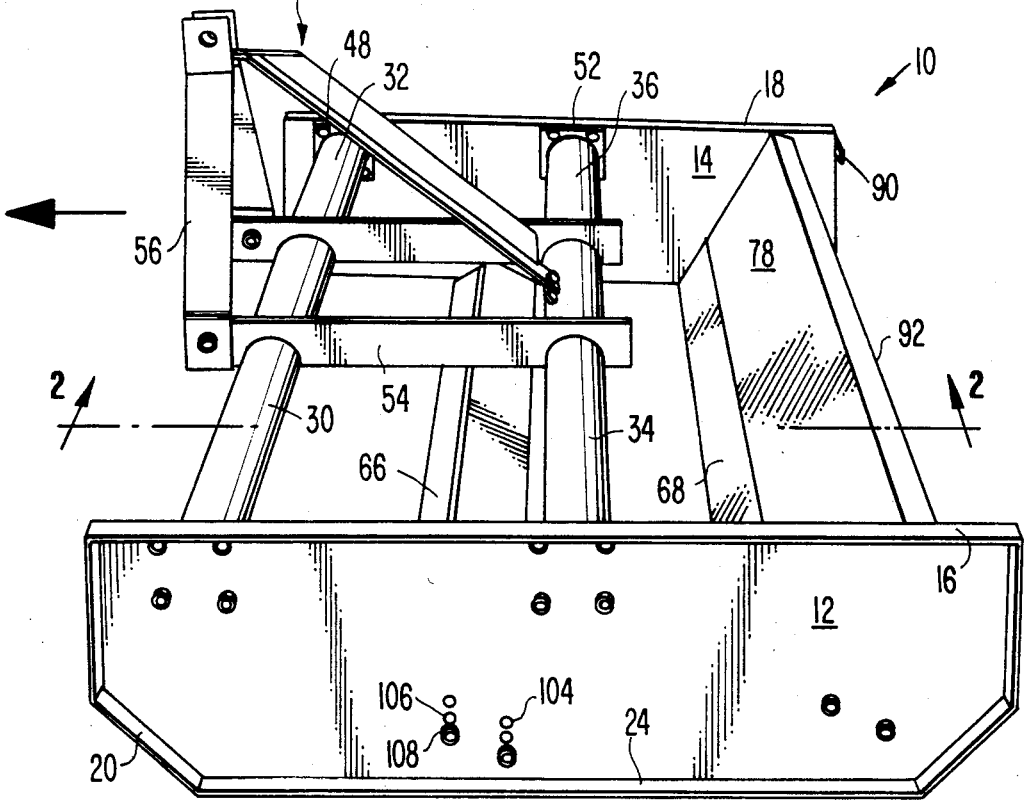
FIG. 1 is a perspective view of a convertible spreader-grader assembly embodying the present invention illustrated in its box scraper mode.
Figure 3:
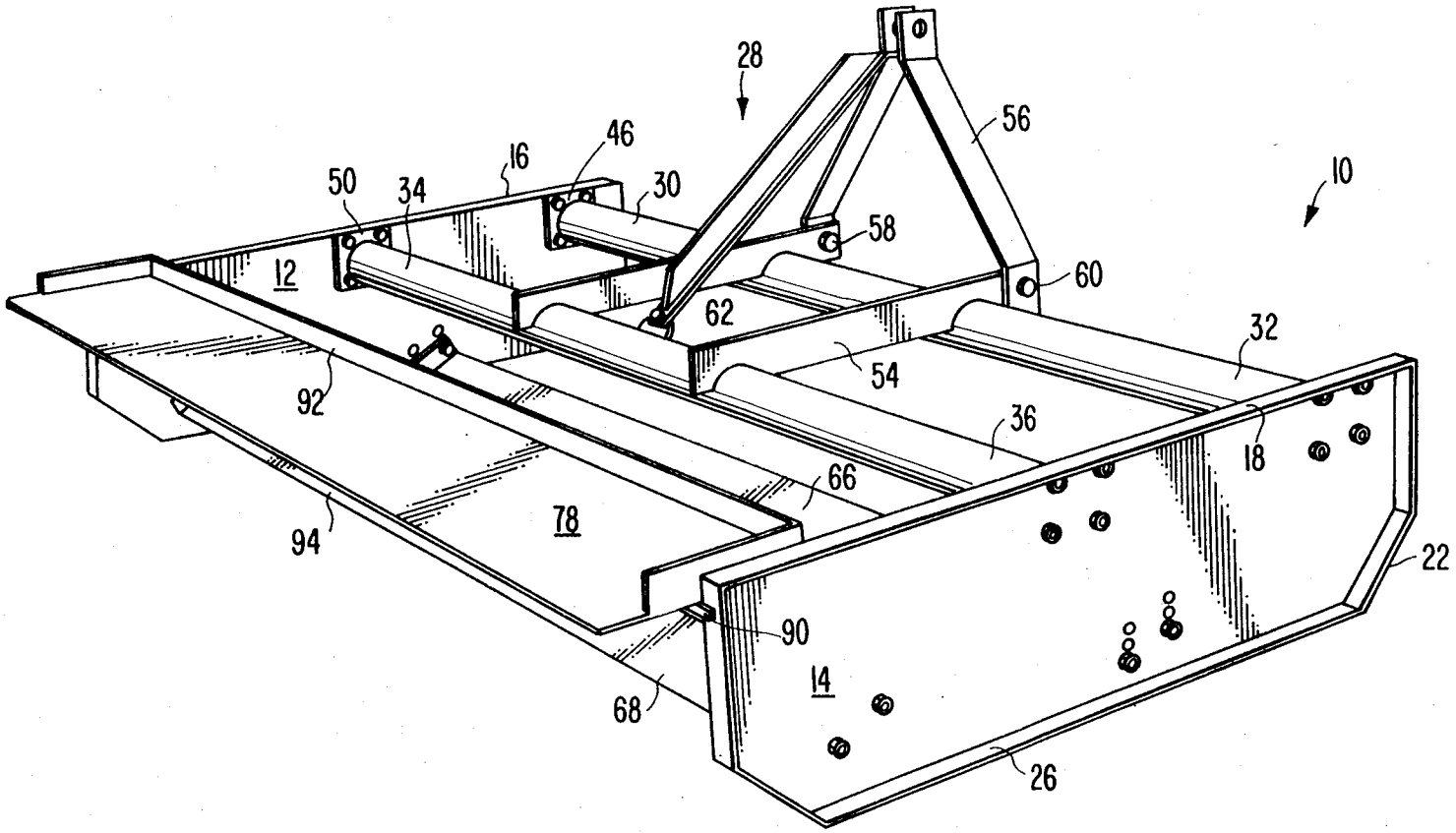
FIG. 3 is another perspective view of the spreader grader assembly of FIG. 1 illustrating the assembly in its spreader grader mode.

Referring to FIGS. 1 and 3, a convertible spreader-grader assembly embodying the present invention is illustrated in perspective generally at 10. Assembly 10 comprises a pair of side skid sleds 12, 14 having reinforced lips 16, 18 extending around their periphery and further including beveled front corners, 20, 22 for minimizing any biting or digging into the ground as the assembly is pulled along the ground on its lower reinforced slidable rail surfaces 24, 26. An interior framework shown generally at 28 is positioned between skid sleds 12, 14 at a forward location thereof. Interior framework 28 includes four extending rail members 30, 32, 34, 36 extending out laterally therefrom. At the ends 38, 40, 42, 44 of each of the four rail members are attachment plates 46, 48, 50, 52, respectively, welded thereto and each having four holes therethrough. The holes are adapted to be mated with similar holes in skid sleds 12, 14, best illustrated in FIGS. 4 and 8, and suitable bolts can be fitted through the registered holes, thereby securing skid sleds 12, 14 to framework 28.

Framework 28 further includes interior structure 54 to which the hitch 56 can be bolted at locations 58, 60, and 62. A three-point hitch is illustrated in FIGS. 1–4, but any suitable hitch, such as a high crop hitch as is illustrated at 64 in FIG. 8, can be used. It is expected that the hitch will be secured to a suitable hydraulic lift on a tractor or similar piece of farm machinery. The hydraulic lift will then lift the front edge of assembly 10 slightly via the hitch as the tractor pulls the assembly around a sweep so that it does not dig into the ground. A pair of parallel, spaced cutter assemblies shown generally at 66, 68 are mounted laterally and extend between skid sleds 12, 14. Forward cutter assembly 66 is mounted generally between and below the rail members and rear cutter assembly 68 is mounted rearward of framework 28. The cutter assemblies include suitable elongated carbon steel blades 70, 72 secured by bolting or other suitable means to their elongated angled blade supports 74, 76. The blades are of sufficient hardness to resist denting when being impacted by rocks, rubble, and the like. The cutter assemblies are secured to skid sleds 12, 14 in an adjustable removable manner as will be described later.

Figure 2:
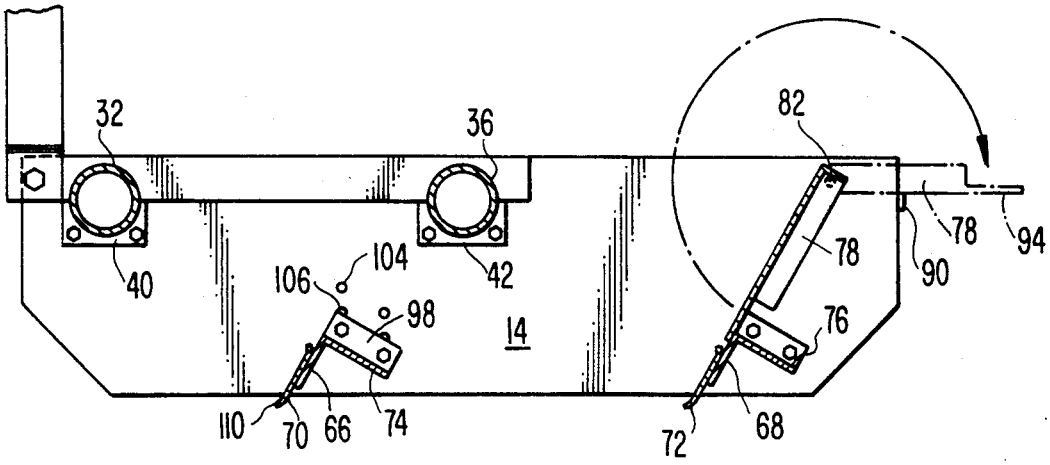
FIG. 2 is a cross-sectional view taken along line 2—2 of FIG. 1 and illustrating in phantom lines the pivotal movement of the boxer plate.

A plate or boxer 78 extends laterally between skid sleds, 12, 14 and has one and one-half inch long rods or pegs 80, 82 projecting out from its ends. Pegs 80, 82 fit into holes 84, 86 in the sides of skid sleds 12, 14 and provide a pivotal connection therebetween. As best illustrated in FIG. 2, boxer 78 is pivotal between a first position illustrated in phantom lines and a second position illustrated in solid lines. When in the first position it is held horizontally by suitable stop pegs 88, 90 which are attached to skid sleds 12, 14 or, alternatively can be attached to the plate itself. When in the first position plate 78 is generally horizontal and spaced above the ground, as shown in FIG. 3. It thereby does not prevent the passage of dirt, earth, asphalt or the like from freely passing underneath it and it thereby functions generally like a traditional spreader grader. When in the second position it rests on and is supported by the rear cutter assembly 68. As shown in FIG. 1, rear cutter assembly 68 and pivotal boxer 78 when in its second position define a rear plate or wall. This wall extends between skid sleds 12, 14 and together therewith forms a box scraper. Thus, as assembly 10 is pulled via hitch 56, dirt, earth, shells, sand, asphalt or the like collects between the skid sleds and against the rear wall.

Figure 4:
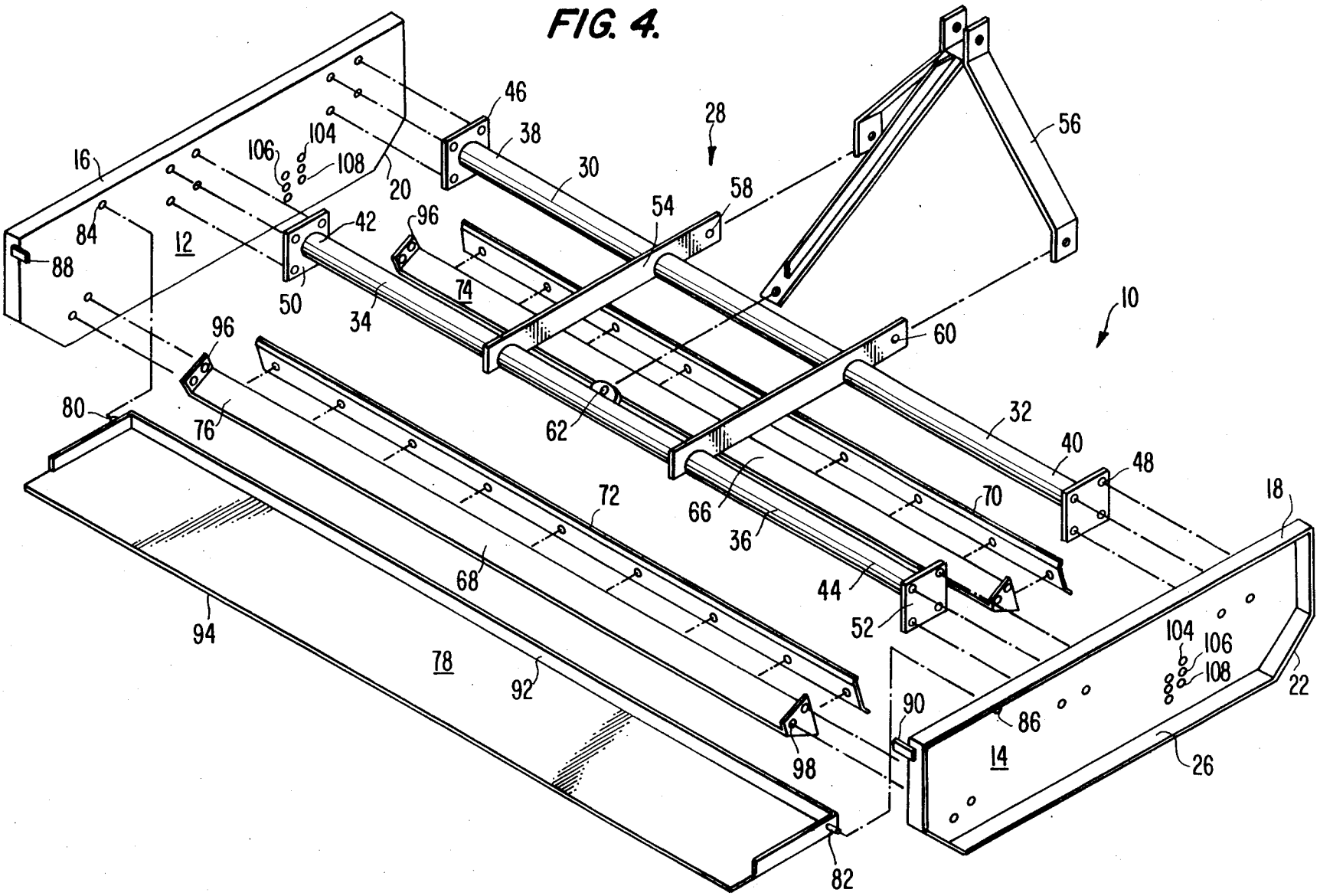
FIG. 4 is an exploded perspective view of the spreader grader assembly of FIG. 3.
Figure 5:
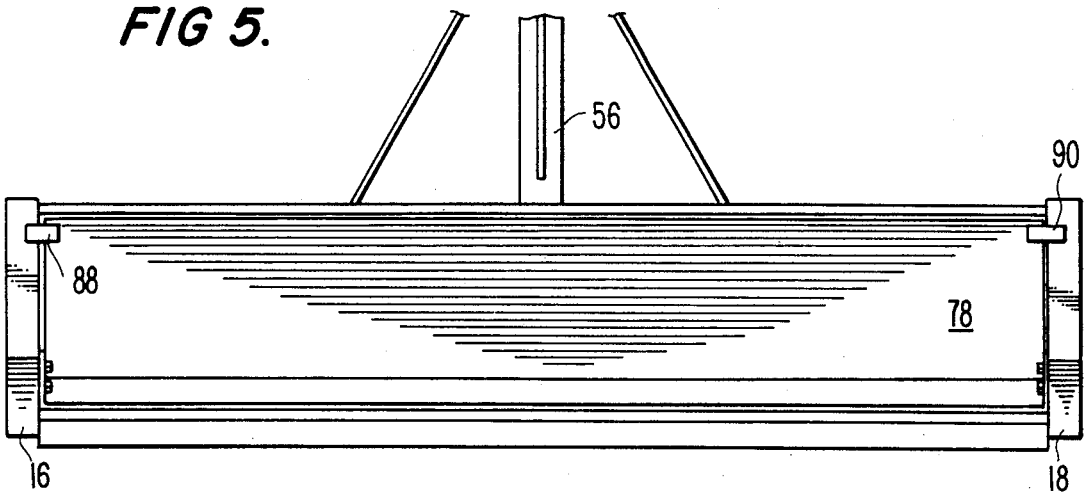
FIG. 5 is a rear elevational view of the spreader grader assembly of FIG. 1 having portions thereof broken away.

Plate 78, as best shown in FIGS. 3 and 4, has a reinforcement lip 92 extending generally three-quarters the way around its perimeter. The lower edge 94 of plate 78 does not have nor need a reinforcement lip since it rests on and is reinforced by rear cutter assembly 68 when it is in the second position. As can be easily imagined, plate 78 can be easily pivoted between its first and second positions by manually grasping lower edge 94 and lifting or moving it to its new position.

Blade supports 74, 76 define a downwardly facing angle and have attachment plates 96, 98 mounted at either end thereof. A pair of holes 100, 102 pass through each said attachment plate 96, 98 for mounting blade supports 74, 76 by suitably sized bolts to skid sleds 12, 14. One or both of the cutter assemblies 66, 68 can be provided with adjustable mounting means for mounting them to skid sleds, 12, 14. One embodiment would provide this adjustable mounting means to the forward blade support only and provide only a single setting for the rear blade support. Referring to FIG. 4 it is shown that three pairs of holes 104, 106, 108 for the forward cutter assembly are punched through the skid sleds. Holes 104, 106, 108 are positioned in diagonal parallel patterns so that when the cutter assembly is repositioned between the upper, lower and middle positions and bolted in the selected position the blade defines the same angle with respect to the ground. The patterns of holes are provided symmetrically and congruently to each of the skid sled 12, 14 to maintain the cutter assemblies in level, non-twisted positions. However, of course, as the blade or cutter assembly is moved between its lower, upper and middle positions, the lower edge 110 of the blade is raised or lowered to a new height with respect to the ground. When in its upper position it is best used on sand and loose dirt, when in its middle position it is best used for rock and shell, and when in its lower position is best used for dirt with grass and weeds or for grassy terrain. These three specific positions more than adequately meet the operator's needs and there is no need for any further settings or for providing for a continuum of blade positions. The simple bolt connections permit easy field adjustment with limited tools. Both of the blades are also conveniently visible to the operator in forward and reverse directions, according to the present design.

Figure 6:
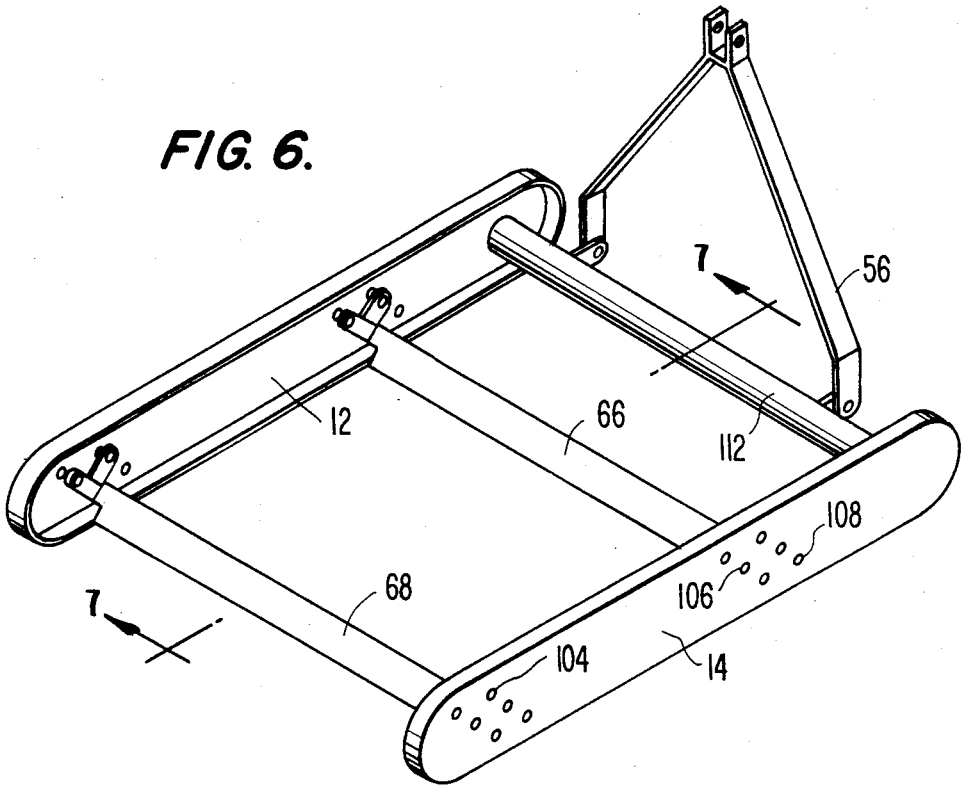
FIG. 6 is a perspective view of a second spreader-grader assembly embodying the present invention.
Figure 7:
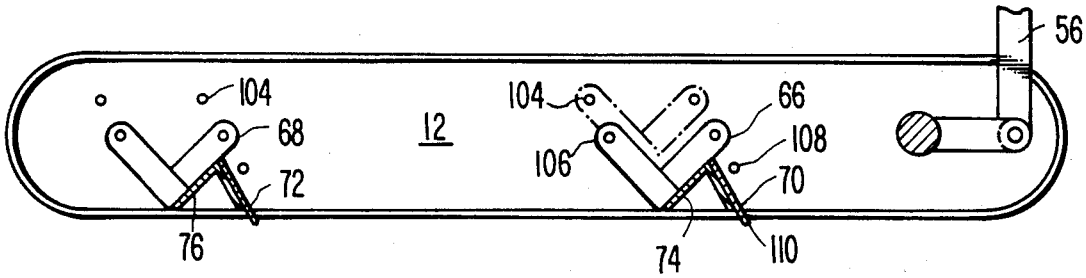
FIG. 7 is a cross-sectional view taken along line 7—7 of FIG. 6.

A second design of the present invention is illustrated in FIGS. 6 and 7, wherein both forward and rear cutter assemblies 66, 68 are provided with this adjustable mounting means. The blades can be easily and manually moved between their lower, middle, and upper positions by simply removing the bolts from the skid sleds, manually moving the cutter assembly to its new position with the holes through the end plates registering with the new selected pair of holes in the both of the skid sleds, and the bolts reinserted and secured therein. It is also within the scope of the embodiment of FIGS. 6 and 7 to freely interchange the forward and rear cutter assemblies 66, 68 as well as to easily replace onr or both of the assemblies when the blade has been worn or damaged. It is further noted that the embodiment of FIGS. 6 and 7 does not include interior framework 28 of FIG. 1 but rather a single strongback rail member 112 extends between two skid sleds 12, 14, is firmly affixed to them and keeps them in rigid parallel alignment. The hitch 114 is then secured to rail member 112.

Figure 8:
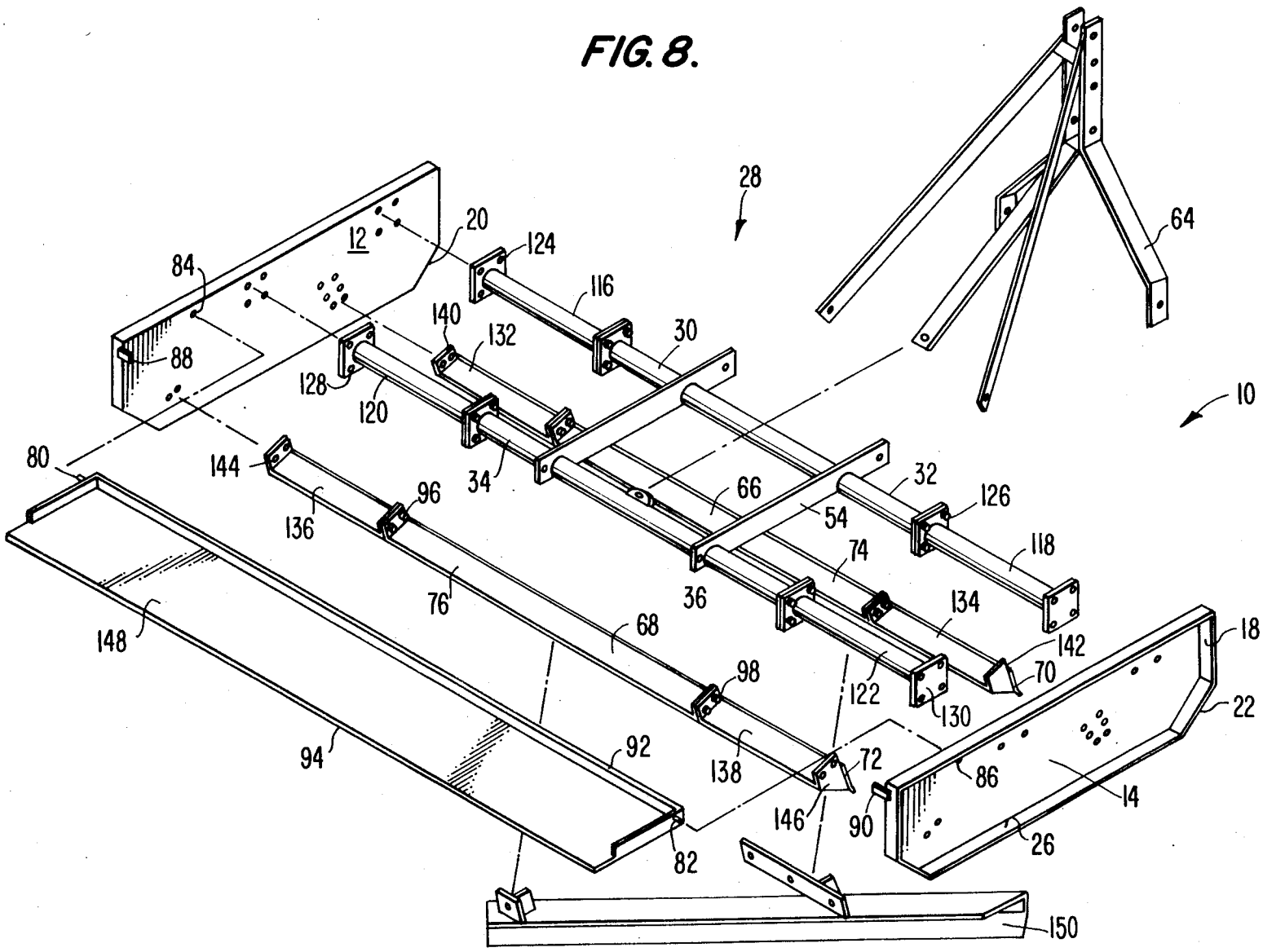
FIG. 8 is an exploded perspective view of a third spreader-grader assembly embodying the present invention and illustrating the extension module system.

Frequently, it is desired to have spreader-grader assemblies of different widths to accommodate different uses. For example, a twelve foot unit might be preferable for use in the field but around the house and on the roads a narrower eight foot section is desirable. The narrower width is often for transporting the assembly on the nation's highways to and from the job site. Assembly 10 can be easily adapted to have different widths from four to sixteen feet in two foot increments. Referring to FIG. 8, it is seen that extension rail members 116, 118, 120, 122 having mounting plates 124, 126, 128, 130 at either end are secured via bolts or other removable means to attachment plates 46, 48, 50, 52 of the rail members and also to skid sleds 12, 14. Also extension cutter assembly members 132, 134, 136, 138 having mounting plates 140, 142, 144, 146 at each of their ends and having the same general cross-sectional configuration as the cutter assemblies 66, 68 are mounted to the end plates of the cutter assemblies and then to skid sleds 12, 14. Extension members are added equally to both sides of the rails and of the cutter assemblies so that hitch 56 remains aligned in the middle of the spreader-grader assembly 10 between the skid sleds 12, 14. When in its extended condition, either suitable similar extension members (not shown) can be provided for the plate 78 or a second longer plate 148 having a similar configuration but a greater length can be used as shown in FIG. 8. It is further noted that the subject adjustable mounting means reduces the high overall interior forces and stresses of assembly 10 to permit the use of these extension subassemblies which otherwise would tend to break at their assembly points.

Another option of the present design is to attach a ditcher 150 by bolting at connections of the front and back brackets to holes of the removed bolts. The three bolts of the front cutting edge of the right side and the bolt on the back cutting edge on the right side are disconnected for installing the ditcher. The ditcher is used, for example, to first move the dirt and gravel up and out of the ditch, which step is then followed by a pass with the blade(s) to spread and grade the material on roadway shoulders.

It is thus a simple procedure for assembling and disassembling the present apparatus. The three-point hitch is first attached to the framework by using hitch pins and a suitable bolt tightly fastened at three connections. The hitch is then attached to the tractor draw works. The blades are next tightly bolted to the blade supports. The cutter assemblies are then loosely bolted to the skid sleds at the desired setting. The interior framework is then positioned between the skid sleds and loosely bolted thereto. Using the tractor draw works, the entire assembly is then lifted and the squareness of the unit and parts is carefully checked and finally all bolts are tightly secured. For the boxer option, the bolts on the back cutting edge assembly and rail members are loosened, and the boxer is positioned between the skid sleds and bolted at the desired said first or second position. For the extension option, the extensions are first loosely bolted to the interior structures and before the skid sled bolts are tightened the extensions are aligned and the bolts tightened. It is thus seen that it is a rather simple procedure to convert the assembly between its spreader-grader and box scraper modes, its different widths and between its different blade settings. It further is very easy to assemble and disassemble the convertible assembly.

From the foregoing detailed description, it will be evident that there are a number of changes, adaptations and modifications of the present invention which come within the province of those persons having ordinary skill in the art. However, it is intended that all such variations not departing from the spirit of the invention be considered as within the scope thereof as limited solely by the appended claims.

I claim:

1. A convertible spreader-grader assembly comprising:

a pair of spaced, longitudinal skid sleds adapted to skid on the ground, an interior framework positioned between said skid sleds, said framework including first and second spaced lateral rail members, said first and second rail members each having opposite outer member ends, a securing means for securing said outer member ends to said skid sleds, a hitch assembly connected to said framework, a cutter assembly extending laterally between said skid sleds, said cutter assembly having a cutting blade extending down therefrom at an angle to the ground and adapted to engage the ground when said framework is pulled via said hitch assembly, an attaching means for attaching opposite end portions of said cutter assembly to said skid sleds, a pivotal plate extending between said skid sleds and positioned behind said framework, and movable between two positions, a connecting means for pivotally connecting end portions of said plate to said skid sleds such that said plate can be pivoted between the first position generally horizontal and spaced above the ground and the second more nearly vertical position in which the lower end of said plate is adjacent said cutter assembly, and said convertible spreader-grader assembly defining a spreader grader when said plate is in said first position whereby earth, soil and the like can pass between said skid sleds and under said plate, and said convertible spreader-grader assembly defining a box scraper when said plate is in said second position such that earth, dirt and the like can be collected between said skid sleds and against said plate as said spreader-grader assembly is pulled via said hitch assembly.

2. The assembly of claim 1 including, a second cutter assembly positioned forward of said cutter assembly and between said first and second rail members and attached at opposite ends thereof to said skid sleds.

3. The assembly of claim 1 including, said hitch assembly comprising a three-point hitch assembly.

4. The assembly of claim 1 including, said hitch assembly comprising a high-crop hitch assembly.

5. The assembly of claim 1 including, a ditcher positioned forward of said plate and extending between and connected to said skid sleds.

6. The assembly of claim 1 including, a first lateral extension pipe attached at its opposite ends to one said skid sled and to said first rail member, a second lateral extension pipe attached at its opposite ends to said one said skid sled and to said second rail member, and a cutter assembly extension extending between and attached to one end of said cutter assembly and to said one said skid sled.

7. The assembly of claim 6 including, a second cutter assembly positioned forward of said second cutter assembly between said first and second rail members and attached at its opposite ends to said skid sleds, and a second cutter assembly extension extending between and attached to one end of said second cutter assembly and said one said skid sled.

8. The assembly of claim 1 including, a stop means attached to said skid sleds for holding said plate in said first position.

9. The assembly of claim 8 including, said plate, when in said second position, resting on and being supported by the upper interior surface of said cutter assembly.

10. The assembly of claim 1 including, said plate, when in said second position, resting on and being supported by the upper interior surface of said cutter assembly.

11. The assembly of claim 10 including, said plate, when in said second position, defining the upper portion of a rear box scraper wall and said cutter assembly defining the lower portion of said rear box scraper wall.

12. The assembly of claim 1 including, said hitch assembly being adapted to be connected to a hydraulic lift on a tractor, and said convertible spreader-grader assembly being adapted to be pulled by said tractor with said skid sleds sliding along the ground in a level manner.

13. The assembly of claim 1 including, said plate having a reinforcement lip extending along its upper and side edges.

14. The assembly of claim 1 including, said attaching means including an angle support means.

15. The assembly of claim 1 including, said attaching means comprising a removable, manually-adjustable blade support means for attaching said cutter assembly in a first position and alternatively in a second position wherein said blade defines the same angle relative to the ground as when in said first position and the lower cutting edge of said blade is spaced a greater distance above the ground than when in said first position.

16. The assembly of claim 15 including, said removable, manually-adjustable blade support means being adapted to attach said cutter assembly in a third position wherein said blade defines the same angle relative to the ground as when in either said first and second positions and the lower cutting edge of said blade is spaced a great distance above the ground than when in either said first and second positions.

17. The assembly of claim 15 including, said blade support means including a first and second pairs of openings through said skid sleds and a pair of bolts for bolting said cutter assembly in said first pair of openings whereby said cutter assembly is in said first position and, alternatively, in said second pair of openings whereby it is in said second position.

18. The assembly of claim 1 including, said connecting means being positioned above said cutter assembly.

19. The assembly of claim 1 including, said boxer including an elongated boxer plate extending generally between said skid sleds.

20. The assembly of claim 19 including, said boxer plate including opposite plate ends, and said connecting means pivotally connecting said plate ends directly to said skid sleds.

21. A convertible spreader-grader assembly comprising:

a pair of spaced, longitudinal skid sleds adapted to skid on the ground, an interior framework positioned between said skid sleds, said framework including first and second spaced lateral rail members, said first and second rail members each having opposite outer member ends, a securing means for securing said outer end members to said skid sleds, a hitch assembly connected to said framework, a cutter assembly extending laterally between said skid sleds, said cutter assembly having a cutting blade extending down therefrom at an angle to the ground and adapted to engage the ground when said framework is pulled via said hitch assembly, an attaching means for attaching opposite end portions of said cutter assembly to said skid sleds, a first lateral extension pipe attached at its opposite ends to one said skid sled and to said first rail member, a second lateral extension pipe attached at its opposite ends to said one said skid sled and to said second rail member, and a cutter assembly extension extending between and attached to one end of said cutter assembly and to said one said skid sled.

22. The assembly of claim 21 including, a second cutter assembly positioned forward of said cutter assembly between said first and second rail members and attached at its opposite ends to said skid sleds, and a second cutter assembly extension extending between and attached to one end of said cutter assembly and to said one said skid sled.

23. The assembly of claim 21 including, said hitch assembly comprising a three-point hitch assembly.

24. The assembly of claim 21 including, said hitch assembly comprising a high-crop hitch assembly.

25. The assembly of claim 21 including, a ditcher extending between and connected to said skid sleds.

26. A convertible spreader-grader assembly comprising:

a pair of spaced, longitudinal skid sleds adapted to skid on the ground, a lateral rail member positioned between said skid sleds, and secured at its opposite ends to said skid sleds, a hitch assembly connected to said lateral rail member, a first cutter assembly extending laterally between said skid sleds, said first cutter assembly having a first blade extending down therefrom at an angle to the ground and adapted to engage the ground when said rail member is pulled via said hitch assembly, a first attaching means for attaching opposite end portions of said first cutter assembly to said skid sleds, said first attaching means comprising a first removable, manually-adjustable blade support means for attaching said first cutter assembly in a first position, relative to said skid sleds and, alternatively, in a second position relative to said skid sleds wherein first blade defines the same angle relative to the ground as when in said first position and the lower cutting edge of said first blade is spaced a greater distance above the ground than when in said first position, a second cutter assembly extending laterally between said skid sleds behind said first cutter assembly, said second cutter assembly having a second blade extending down therefrom at an angle to the ground and adapted to engage the ground when said rail member is pulled via said hitch assembly, a second attaching means for attaching opposite end portions of said second cutter assembly to said skid sleds, said second attaching means comprising a second removable, manually-adjustable blade support means for attaching said second cutter assembly in a first position and, alternatively, in a second position wherein said second blade defines the same angle relative to the ground as when in said first position and the lower cutting edge of said second blade is spaced a greater distance above the ground than when in said first position, said first removable, manually-adjustable blade support means being adapted to attach said first cutter assembly in a third position relative to said skid sleds wherein said first blade defines the same angle relative to the ground as when in either said first and second positions and the lower cutting edge of said blade is spaced a greater distance above the ground than when in either said first and second positions, a first lateral extension pipe attached at its opposite ends to one said skid sled and to said lateral rail member, a first cutter assembly extension extending between and attached to one end of said first cutter assembly and to said one said skid sled, and a second cutter assembly extension extending between and attached to one end of said second cutter assembly and said one said skid sled.

27. The assembly of claim 26 including, said first blade support means including a first and second pairs of openings through said skid sleds and a pair of bolts for bolting said first cutter assembly in said first pair of openings whereby said first cutter assembly is in said first position, and, alternatively, in said second pair of openings whereby it is in said second position.

28. The assembly of claim 26 including, a first lateral opposite extension pipe attached at its opposite ends to the other said skid sled and to said lateral rail member, a first cutter assembly opposite extension extending between and attached to the other end of said first cutter assembly and to said other said skid sled, and a second cutter assembly opposite extension extending between and attached to the other end of said second cutter assembly and said other said skid sled.

29. The assembly of claim 26 including, said first attaching means including a first angle support means.

* * * * *